US007473025B1

(12) United States Patent
Howk

(10) Patent No.: US 7,473,025 B1
(45) Date of Patent: Jan. 6, 2009

(54) MIXING IMPELLER WITH SPIRAL LEADING EDGE

(75) Inventor: Richard Howk, Pittsford, NY (US)

(73) Assignee: SPX Corporation, Charlotte, NC (US)

( * ) Notice: Subject to any disclaimer, the term of this patent is extended or adjusted under 35 U.S.C. 154(b) by 0 days.

(21) Appl. No.: 12/023,709

(22) Filed: Jan. 31, 2008

(51) Int. Cl.
*B01F 7/22* (2006.01)
*B01F 7/26* (2006.01)

(52) U.S. Cl. ..... 366/270; 366/317; 366/330.4; 29/889.7

(58) Field of Classification Search ..... 366/102–104, 366/262–265, 315–317, 342–343, 270, 330.1–330.7; 261/84, 87, 93; 416/197 R, 243, 237, 203, 416/242, 223 R; 210/208, 219; 29/889, 29/889.6, 889.7
See application file for complete search history.

(56) References Cited

U.S. PATENT DOCUMENTS

| | | | | | |
|---|---|---|---|---|---|
| 1,850,199 | A | * | 3/1932 | Bryant | 366/330.7 |
| 3,030,083 | A | * | 4/1962 | Stiffler | 416/199 |
| 3,542,343 | A | * | 11/1970 | Stoelting | 366/317 |
| 4,482,298 | A | * | 11/1984 | Hannon et al. | 416/234 |
| 4,571,090 | A | | 2/1986 | Weetman et al. | |
| 4,577,975 | A | * | 3/1986 | McCrory et al. | 366/314 |
| 4,900,159 | A | * | 2/1990 | Jamison | 366/343 |
| 5,249,993 | A | * | 10/1993 | Martin | 440/73 |
| 5,934,877 | A | * | 8/1999 | Harman | 416/223 R |

FOREIGN PATENT DOCUMENTS

| | | | |
|---|---|---|---|
| EP | 79396 | A1 * | 5/1983 |
| EP | 896834 | A2 * | 2/1999 |
| FR | 2549402 | A2 * | 1/1985 |

OTHER PUBLICATIONS

ITT Flygt USA—slow speed mixers, http://www.flygtus.com/116191.asp Jan. 30, 2008.
ITT Flygt USA, Compact mixers; http://www.flygtus.com/116151.asp.

* cited by examiner

*Primary Examiner*—Charles E Cooley
(74) *Attorney, Agent, or Firm*—Baker & Hostetler LLP

(57) ABSTRACT

An impeller blade has a flat central disk portion, at least a pair of extensions extending from a central disk portion, and at least two leading edges defined by the outer periphery of the disk portion. Each leading edge spans from one extension to an adjacent extension, and each leading edge has at least a portion at which the radius of the leading edge from the center increases to form a continuous increasing radius curve. Each leading edge forms an increasing radius spiral edge surface in between the extensions.

20 Claims, 2 Drawing Sheets

MIXING IMPELLER WITH SPIRAL LEADING EDGE

FIELD OF THE INVENTION

The invention pertains generally to mixing impellers, and more particularly to mixing impellers which are submerged in or at least partially in liquid material and rotated by a motor-driven shaft.

BACKGROUND OF THE INVENTION

Mixing impellers are in wide use in industry. Examples of industrial mixing impellers include designs which have a central hub and two, three, four or more radially extending blade type structures. These blades may be flat, angled, and in some cases have a wing or propeller shape. Typically, the impellers extend radially outwardly from a motor driven shaft and are submerged inside a material to be mixed. Oftentimes the impellers are in an at least partially liquid mix which is being confined in a vessel, which may be holding the material in a batch process or a continuous process.

In some types of mixing applications, an undesirable phenomenon occurs wherein various solid materials that are entrained in the liquid material being mixed will accumulate on the leading edge of the blade and form lumps, strings, or so-called "rags." A way to understand this phenomenon is to consider impellers used on boats, which will capture weeds that will then adhere to a leading edge of the boat propeller and impede its operational efficiency. Similarly, a ceiling fan will often accumulate dust from the air on its leading edge which will form into elongated filaments or streams.

A similar phenomenon occurs, particularly, for example, in the case of mixing impellers used for wastewater or sewage water treatment, wherein the material being mixed often has various types of crud, solid particulates, hair and other non-dissolving material. As the water is being treated, these materials sometimes tend to adhere to the leading edge of existing impeller types, which reduces the flow over the impeller type, and reduces the efficiency of the impeller.

In many industrial applications, the impellers are so-called "axial flow" in which the liquid in the region of the impeller is being pumped in the direction generally parallel to the axis of the shaft (perpendicular to the direction of extension of the blades). In other instances, the impellers may be the so-called "radial flow" type, in which the material is generally being urged radially outwardly away from the shaft in a direction parallel to the direction of extension of the blades. Some of these impellers have been known to utilize a circular disk having paddles radially extending outwardly therefrom.

In view of the foregoing, it would be desirable to have a mixing impeller that can mitigate, at least to some extent, the effect of the development of "rags" or other collections adhering to the leading edge of the impeller, or to any edge of the impeller.

SUMMARY OF THE INVENTION

Some aspects of some embodiments of the invention provide a mixing impeller that can mitigate, at least to some extent, the effect of the development of "rags" or other collections adhering to the leading edge of the impeller, or to any edge of the impeller.

One embodiment of the present invention provides an impeller having a central disk portion, at least a pair of extensions extending from a central disk portion, and at least two leading edges defined by the outer periphery of the disk portion, each leading edge spanning from one extension to an adjacent extension, and each leading edge having at least a portion at which the radius of the leading edge from the center increases to form a continuous increasing radius curve.

An impeller blade has a central disk portion, at least a pair of flow inducing means extending from the central disk portion, and at least two leading edges defined by the outer periphery of the central disk portion, each leading edge spanning from one flow inducing means to an adjacent flow inducing means, and each leading edge having at least a portion at which the radius of the leading edge from the center increases to form a continuous increasing radius curve.

The impeller has the central disk portion lies in a plane, and each flow inducing means projects away from the disk at an angle relative to the plane.

The impeller has the number of flow inducing means which comprise at least three and the number of leading edges comprises at least three, and wherein the flow inducing means and the leading edges are symmetrical with each other.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Some embodiments of the present invention provide an impeller having a central disk portion, at least a pair of extensions extending from a central disk portion, and at least two leading edges defined by the outer periphery of the disk portion, each leading edge spanning from one extension to an adjacent extension, and each leading edge having at least a portion at which the radius of the leading edge from the center increases to form a continuous increasing radius curve. An aspect of this is that design provides in some circumstances a mixing impeller that can mitigate, at least to some extent, the effect of the development of "rags" or other collections adhering to the leading edge of the impeller, or to any edge of the impeller.

Figure 1:
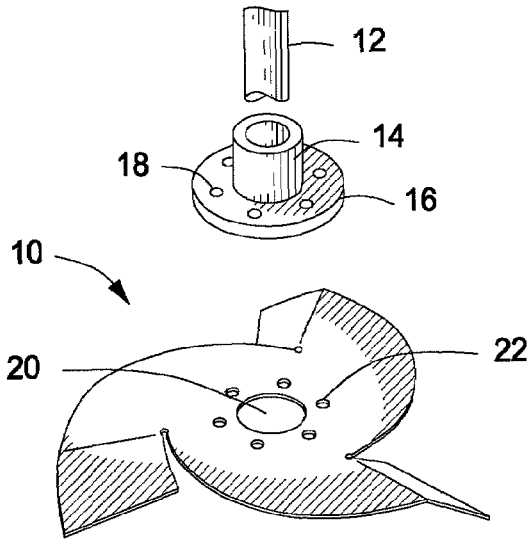
FIG. 1 is a perspective exploded view showing an impeller according to one example of a preferred embodiment of the invention.

Some preferred embodiments will now be described with reference to the drawing figures, in which like reference numbers refer to like parts throughout. FIG. 1 illustrates an impeller 10 which can be mounted to a shaft 12 via a mounting hub 14. The shaft 12 is illustrated as cut off, but typically would extend all the way through the hub 14 or the hub 14 can be mounted at the end of the shaft 12. Thus, several impellers 10 can be mounted along the length of a shaft. Typically, the shaft 12 extends inside a vessel (not shown) containing the material to be mixed, and is driven by a motor outside the vessel.

In the example shown, the hub 14 has a radially outward extending mounting flange 16 with a central base and a plurality of bolt holes 18 therethrough. The impeller 10 has a central aperture 20, through which the shaft 12 can pass, and also has a plurality of bolt holes 22 therethrough corresponding to the bolt holes 18. In this way, the impeller 10 can be rigidly affixed to the hub 14 by bolts passing through the bolt holes 22 and 18, respectively. The hub 14 can be affixed onto the shaft 12, both axially and rotationally, via any of many known attachment methods. For example, the hub 14 can be welded to the shaft 12. Similarly, the impeller 10 can be mounted to the hub 14 via any known attachment method, including, for example, by being welded. Also, the hub 14 could be integral with or permanently attached to the impeller 10.

Figure 2:
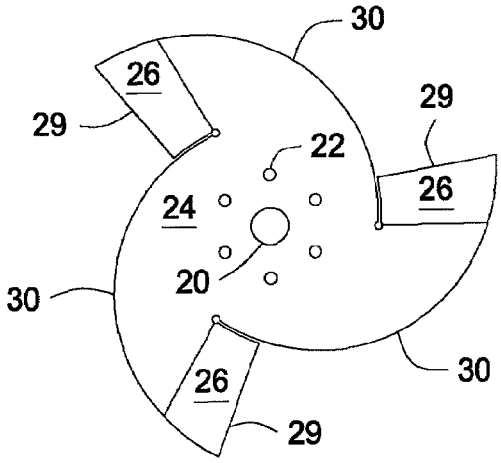
FIG. 2 is a top view of the impeller illustrated in FIG. 1.
Figure 3:
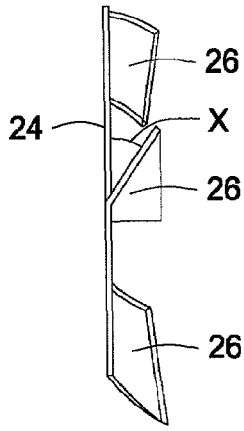
FIG. 3 is a side view of the impeller illustrated in FIG. 1.

Turning now in more detail to FIGS. 1-3, the illustrated impeller 10 includes a central disk region 24 which is substantially in the shape of a flat plate. One or more (in this case three) downwardly bent extensions 26 are provided and angle away from the disk region 24 as shown. In the illustrated example, the extensions 26 project away from the plane of the central disk portion 24 by a band angle X of approximately 30 degrees. It will be appreciated that this angle can be varied anywhere from practically zero up to 90 degrees, or anything up to 180 degrees. In the example shown, the 30 degree angle provides for generally axial flow pumping. If the blade is bent to 90 degrees, more radial flow pumping will occur.

In the example, three projecting extensions 26 are illustrated; however, any number of one or more, preferably two or more, extensions may be provided. In most preferred embodiments, the extensions will be two or more and will be symmetrically disposed around the circumference of the central disk region 24. Also, as discussed further below, the impeller blade 10 may optionally be a unitary design as shown in FIGS. 1-3. Such a design is convenient to form from a single flat plate which is cut to the desired outline shape, and then can have the extensions 26 bent downwardly by a suitable mechanical process.

However, in some cases, for example, in the case of large size impellers, it may be desirable to fabricate the impeller 10 from a plurality of parts that are welded together or otherwise attached to each other. For example, the individual extensions 26 can each be welded on at an angle to the central disk portion 24, and/or the central disk 24 itself and an associated extension can be made of individual components each with an associated extension.

Figure 4:
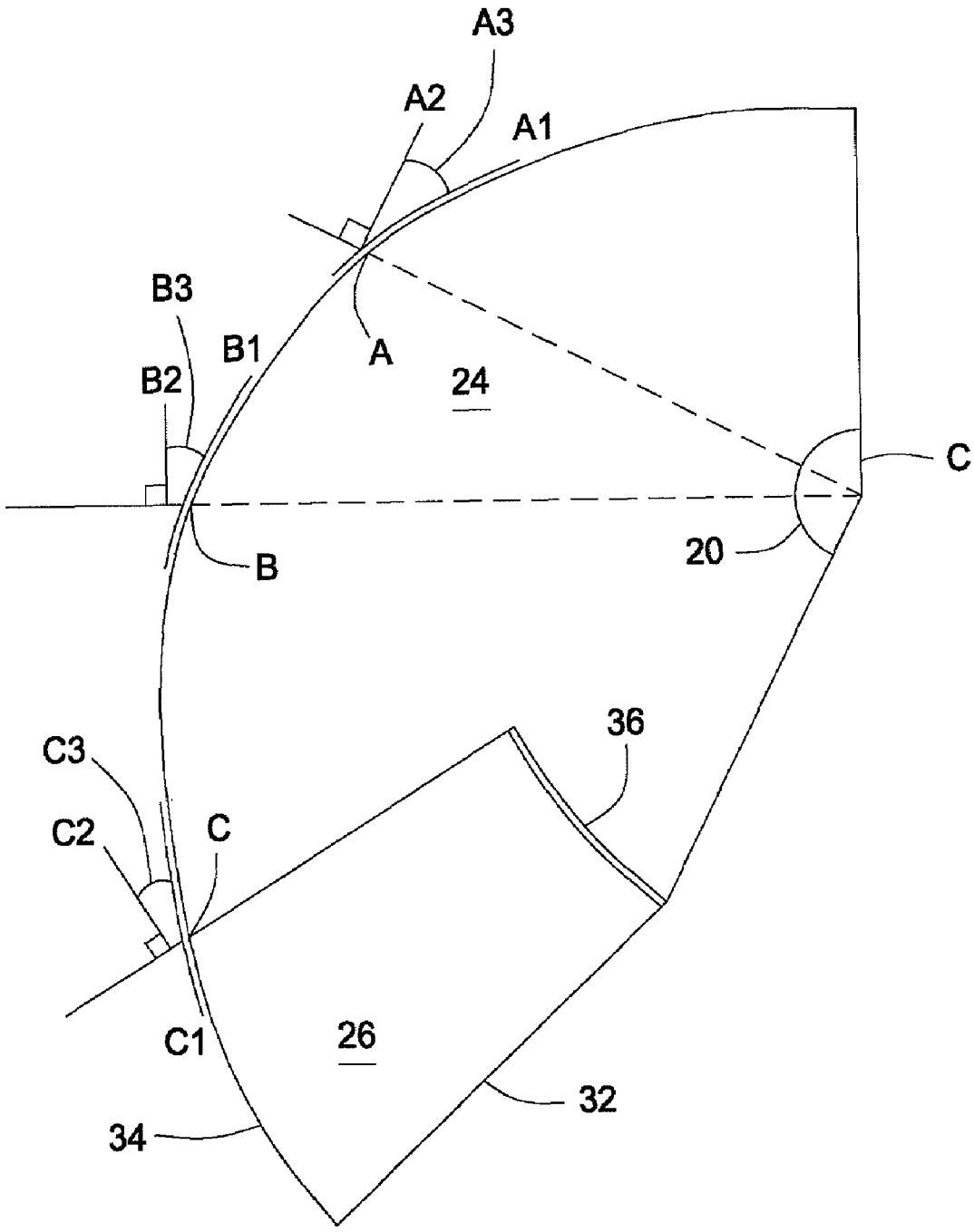
FIG. 4 is a geometric diagram illustrating some design aspects of an impeller according to another preferred embodiment of the invention.

In a further variation, the embodiment of FIGS. 1-3 can be fabricated by welding together three plates, each plate being, for example, in the shape shown in FIG. 4. The plates can be configured so they are welded together end-to-end, thus creating a flat central disk portion 24, or they may be fabricated to overlap each other and thus be stacked on each other. In such a case, the central disk portion 24 would have a greater thickness equal to the number of stacked plates. Also, if the thickness of the plates is relatively thin overall, then it may be sufficient to have the thickness of the central disk portion 24 having steps formed where the plates overlap.

The central disk portion 24 has a number of leading edges 30, with the number of leading edges 30 corresponding to the number of extensions 26. Each leading edge 30 extends from the transition location of one of the extensions 26 outward to the beginning of the transition of the next adjacent extension 26.

As can be seen in FIG. 2, and as illustrated in more detail in FIG. 4, each leading edge 30 has an increasing radius from the center of the disk as it extends from the inside of one extension 26 to the outside of the other extension 26. That is, each leading edge 30 begins in the direction opposite to the direction of rotation with a smaller radius, and has its radius continually increase in the direction opposite to the direction of rotation until finally terminating at the next extension 26.

FIG. 4 illustrates a point A on the leading edge 30 of the central disk portion 24, located approximately 30 degrees from the beginning of the leading edge 30. At this point, there is an angle of attack (between the leading edge 30 and the material being mixed) included between the lines A1 (which illustrates a tangent line to the leading edge at that point), and a line A2 (which is a line perpendicular to the radius at that location). It will be appreciated that the next angle of attack between lines B1 and B2 at location B, which is approximately 60 degrees from the beginning of the leading edge 30, is higher than at A and increases further to a yet larger angle between lines C1 and C2 at location C.

Thus, the leading edge 30 forms a continuous outward spiraling shape. A benefit of this continued outward spiraling shape is that the leading edge 30 cuts its way through the material in such a fashion that "rags" tend to be minimized and not to adhere to the leading edge 30. The angle between the leading edge 30 and the material being mixed (the angle of attack) is kept to be a suitably small angle but is also continuously gradually changing to a larger angle, so that the leading edge 30 tends to be in shear with the material being mixed and tends not to collect "rags."

In the examples illustrated in FIGS. 1-4, the angle of attack is gradually increasing continuously along its length. However, in other embodiments, it may be only a portion of the leading edge 30 that has this gradual change in angle of attack. In such instances, some parts of the leading edge 30 may be simply arcuate (circular) around the center of rotation of the blade. Also, the circular or spiral arcs described herein can be composed of adjacent straight segments approximating a circular or spiral shape.

The extensions 26 illustrated in FIG. 3 are in the form of a flat planar paddle. However, the extensions 26 can have any shape, and, rather than being flat, may be curved or be formed of multiple flat pieces at angles to each other. Further, the trailing edge of the extensions 26 are illustrated as a flat linear trailing edge 29. However, if desired for the application or in some instances to further reduce rag collection on the trailing edge, the trailing edges 29 may be serrated, curved, castellated, or otherwise shaped.

The sides 34 and 36 of the extensions are illustrated as being generally straight or slightly arcuate. The outer side edge 34 is illustrated as being a shape resulting from initial formation of a flat plate 24, and thus the edge 34 is a geometric continuation of the leading edge 30. The inner edge of the extension 26 is illustrated as being that which results from providing a cut line into the plate 24 as essentially a continuation of the leading edge 30, at the illustrated location. However, the side edges 34 and 36 can also have other shapes, and for example, the extensions 26 rather than being a relatively rectangular flat extension, as illustrated, could be triangular, trapezoidal, or have any other shape. This may be particularly advantageous where the extensions 26 are a separately formed piece that is independently welded onto the central disk portion 24.

An advantage of the embodiment illustrated in FIGS. 1-3 is that it can be extremely simple to manufacture. A flat sheet material can be cut, and then have each extension bent downwardly. Of course, other manufacturing methods may be used, and as discussed above, the entire impeller 10 can be integral, or made of a plurality of individual components which are attached together.

An advantage of this manufacturing method is also that a single set of flat impeller blanks can be cut out, and then different ones can have each of their blades bent to different bend angles, permitting easy, test, adjustment, or adaptation of the impellers. Different power factors or performance are possible from the same blank simply by varying the angle at which the extensions are bent.

In this description of the preferred embodiment, the word "blade" and "impeller" are used to refer to the entire impeller structure, which includes a central disk portion that forms leading edges 30, as well as the extensions 26. Of course, the extensions 26 could each be considered as blades, and are also referred to as flow inducer portions. The selection of the term "blade" to describe the entire impeller and the use of "extensions" to describe those components is for convenience and not intended to limit the scope of the description in any way. Also, the "disk," "disk portion," "central disk portion" and "central disk region" and the like refer to the flat structure that comprises the leading edges, or to the structure other than the extensions.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. An impeller blade comprising:

a central disk portion having a center axis;

at least a pair of extensions extending at an angle from the central disk portion; and at least two leading edges defined by an outer periphery of the central disk portion, each leading edge spanning from one extension to an adjacent extension, and each leading edge having at least a portion at which the radius of the leading edge from the center axis increases to form a continuous increasing radius curve.

2. The impeller of claim 1, wherein each leading edge has at least a portion having an outward increasing spiral profile.

3. The impeller of claim 1, wherein the central disk portion lies substantially in a plane, and each extension projects away from the disk at an angle relative to the plane.

4. The impeller of claim 3, wherein each extension comprises a flat plate angled away from the plane of the central disk portion.

5. The impeller of claim 1, wherein the number of extensions comprises two and the number of leading edges comprises two, and wherein the extensions and the leading edges are symmetrical with each other.

6. The impeller of claim 1, wherein the number of extensions comprises at least three and the number of leading edges comprises at least three, and wherein the extensions and the leading edges are symmetrical with each other.

7. The impeller of claim 1, further comprising a hub mounted to the central disk portion to facilitate mounting of the impeller onto a shaft.

8. The impeller of claim 1, wherein the central disk portion is made up of at least two plates, with each plate having a respective extension projecting therefrom.

9. The impeller of claim 1, wherein the central disk portion is made up of at least three plates, with each plate having a respective extension projecting therefrom.

10. The impeller of claim 9, wherein at least some portions of each plate overlap each other.

11. The impeller of claim 1, in which the central disk portion and the extensions are each provided by a single integral common structure.

12. The impeller of claim 1, wherein each entire leading edge has a radius that increases from the beginning of the leading edge to the end of the leading edge to form a continuous increasing radius curve along the entire leading edge.

13. The impeller of claim 12, wherein the entire length of each leading edge has an outward increasing spiral profile.

14. The impeller of claim 1, wherein each extension has a radial width, and wherein each leading edge begins at a radius inside or adjacent the radial width of the extension, and ends at a radius outside or adjacent the width of the extension.

15. An impeller blade comprising:

a central disk portion having a center axis;

at least a pair of flow inducing means extending from the central disk portion; and at least two leading edges defined by the outer periphery of the central disk portion, each leading edge spanning from one flow inducing means to an adjacent flow inducing means, and each leading edge having at least a portion at which the radius of the leading edge from the center axis increases to form a continuous increasing radius curve.

16. The impeller of claim 15, wherein each leading edge has at least a portion having an outward increasing spiral profile.

17. A method of forming an impeller blade comprising the steps of:

providing a central disk portion having a center axis;

forming at least a pair of extensions extending from the central disk portion; and shaping at least two leading edges defined by the outer periphery of the central disk portion, each leading edge spanning from one extension to an adjacent extension, and each leading edge having at least a portion at which the radius of the leading edge from the center axis increases to form a continuous increasing radius curve.

18. The method according to claim 17, wherein the step of forming the extension comprises bending the extensions downward from the disk portion.

19. A method for treating a material, comprising:

containing the material to be treated in a vessel; and rotationally driving a shaft having an impeller blade comprising:

a central disk portion having a center axis;

at least a pair of extensions extending from the central disk portion; and at least two leading edges defined by the outer periphery of the central disk portion, each leading edge spanning from one extension to an adjacent extension, and each leading edge having at least a portion at which the radius of the leading edge from the center axis increases to form a continuous increasing radius curve.

20. The method according to claim 19, wherein the material being treated is at least one of waste water or sewage water.

* * * * *